US008015707B2

(12) United States Patent
Locatelli et al.

(10) Patent No.: US 8,015,707 B2
(45) Date of Patent: Sep. 13, 2011

(54) METHOD OF FABRICATING A COMBUSTION CHAMBER

(75) Inventors: David Locatelli, Gex (FR); Didier Hippolyte Hernandez, Quiers (FR); Patrick Audin, Corbeil (FR)

(73) Assignee: SNECMA, Paris (FR)

( * ) Notice: Subject to any disclaimer, the term of this patent is extended or adjusted under 35 U.S.C. 154(b) by 1266 days.

(21) Appl. No.: 11/627,715

(22) Filed: Jan. 26, 2007

(65) Prior Publication Data

US 2007/0175029 A1 Aug. 2, 2007

(30) Foreign Application Priority Data

Feb. 1, 2006 (FR) ..... 06 50352

(51) Int. Cl.
*B21D 53/00* (2006.01)

(52) U.S. Cl. ..... 29/890.01; 60/796; 228/155; 219/61

(58) Field of Classification Search ..... 29/890.01; 60/740, 748, 754, 796, 799; 228/112.1, 155; 219/61, 75

See application file for complete search history.

(56) References Cited

U.S. PATENT DOCUMENTS

| | | | | |
|---|---|---|---|---|
| 4,195,475 | A * | 4/1980 | Verdouw | 60/754 |
| 4,458,481 | A | 7/1984 | Ernst | |
| 6,986,452 | B2 * | 1/2006 | Dracup et al. | 228/112.1 |
| 7,168,606 | B2 * | 1/2007 | Badrak | 228/155 |
| 7,241,961 | B2 * | 7/2007 | Duret et al. | 219/61 |

FOREIGN PATENT DOCUMENTS

| | | |
|---|---|---|
| GB | 791752 | 3/1958 |

* cited by examiner

*Primary Examiner* — Richard Chang
(74) *Attorney, Agent, or Firm* — Oblon, Spivak, McClelland, Maier & Neustadt, L.L.P.

(57) ABSTRACT

A welded assembly of combustion chamber elements is disclosed. Two subassemblies of the combustion chamber are fabricated by butt-welding, and a first subassembly has an intermediate connection ring welded thereto suitable for performing final welding with the second subassembly.

9 Claims, 2 Drawing Sheets

METHOD OF FABRICATING A COMBUSTION CHAMBER

The invention relates to a method of fabricating a combustion chamber by assembling together preformed shells; more particularly the invention relates to the way in which assembly is performed, eliminating any need for seam welding. The invention applies advantageously to fabricating so-called "reverse-flow" combustion chambers.

The invention also relates to a forward-flow combustion chamber obtained by implementing the method, and to a turbojet fitted with a combustion chamber of the invention.

BACKGROUND OF THE INVENTION

A so-called reverse-flow combustion chamber is generally made up of metal sheet stamped to constitute shells. The shells are assembled together. For assembly purposes, the shells often have annular tongues that are assembled flat thereto by seam welding.

These welded-on tongues project outside the combustion chamber, thereby leading to head losses in the stream of air flowing around the combustion chamber. In addition, mechanical weakness remains in these tongues, particularly in a reverse-flow combustion chamber, while the outer bend of the chamber is being subjected to bending.

In addition, that assembly technique leads to thermomechanical stresses and raises problems of accessibility if it is desired to use a laser to perforate the combustion chamber.

Attempts have recently been made to reduce the number of annular tongues by making use of butt welded assembly techniques. Nevertheless, the solutions that have been envisaged until now have not made it possible completely to eliminate seam welding.

OBJECT AND SUMMARY OF THE INVENTION

The invention makes it possible to achieve that objective.

More particularly, the invention provides a method of fabricating a combustion chamber essentially made up of welded-together shells, the method comprising:

making separately two subassemblies of such shells by butt-welding the shells together, with an intermediate connection ring being welded to one end of a first subassembly, the intermediate ring including an assembly surface;

engaging one end of a second subassembly on said surface; and welding it to said intermediate ring.

In order to fabricate a so-called "reverse-flow" combustion chamber, the first subassembly is mainly constituted by outer shells and the second subassembly is mainly constituted by inner shells. The shells of each subassembly are assembled together by butt-welding. A flat-bottomed shell constitutes a chamber end wall for carrying the injectors, and this chamber end wall constitutes a portion of one of the subassemblies prior to final welding.

By way of example, one of the subassemblies includes such a chamber end wall and one of the ends of said chamber end wall constitutes the end of said second subassembly that is to be welded to said intermediate ring.

In a manner that is itself known, butt-welding is always performed by adjusting the docking of the two annular parts concerned by means of radial expander tools that enable the parts to be abutted edge to edge for welding purposes.

The intermediate connection ring is a part that is machined at least in part, having accurate dimensions. It can therefore perform a centering function at the moment when the two subassemblies are finally assembled together by orbital welding. Such assembly can be performed by laser welding or by tungsten inert gas (TIG) welding.

In addition, the intermediate connection ring itself includes or constitutes the filler metal needed for welding to the second subassembly.

A combustion chamber of the invention is thus made up of a plurality of preformed shells including a chamber end wall, which shells are assembled together by butt-welding with the exception of a junction between two subassemblies of such shells, said junction being made by interposing an above-mentioned intermediate connection ring.

BRIEF DESCRIPTION OF THE DRAWINGS

The invention can be better understood and other advantages thereof appear more clearly in the light of the following description of a method of fabricating a "reverse-flow" combustion chamber in compliance therewith, given purely by way of example and made with reference to the accompanying drawings, in which.

MORE DETAILED DESCRIPTION

The drawings briefly described above are diagrammatic half-sections showing annular shells or other annular parts united in succession to make up a reverse-flow combustion chamber. With the exception of the welding shown in FIG. 3, which is orbital welding specific to the invention enabling two already welded-together shell subassemblies to be themselves connected together, the other operations described with reference to FIGS. 1A to 1C and with reference to FIGS. 2A to 2C can be effected in another order. In contrast, the operation shown diagrammatically in FIG. 3 is the last welding operation.

The butt-welding mentioned with reference to FIGS. 1A to 1C and 2A to 2C is indicated by arrows.

Figure 1A:
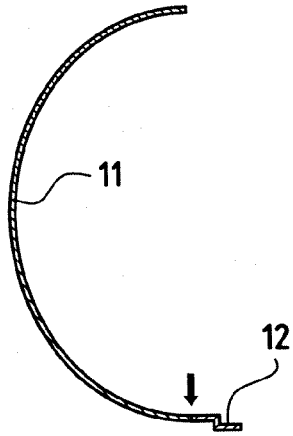
FIGS. 1A to 1C show various welding operations for making up a first subassembly.

In FIG. 1A, butt-welding is performed under an inert gas; a metal sheet stamped to the shape of a shell 11 forming the outer bend of the combustion chamber is welded to an optionally machined connection ring 12. The ring is for use subsequently to make a connection between the chamber outlet and a high pressure turbine.

Figure 1B:
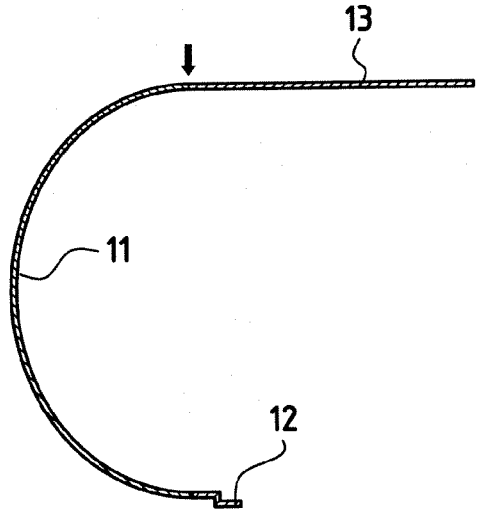

As shown in FIG. 1B, butt-welding is then performed under an inert gas between the other end of the outer bend and one end of a cylindrical shell 13 forming the outer wall of the combustion chamber.

Figure 1C:
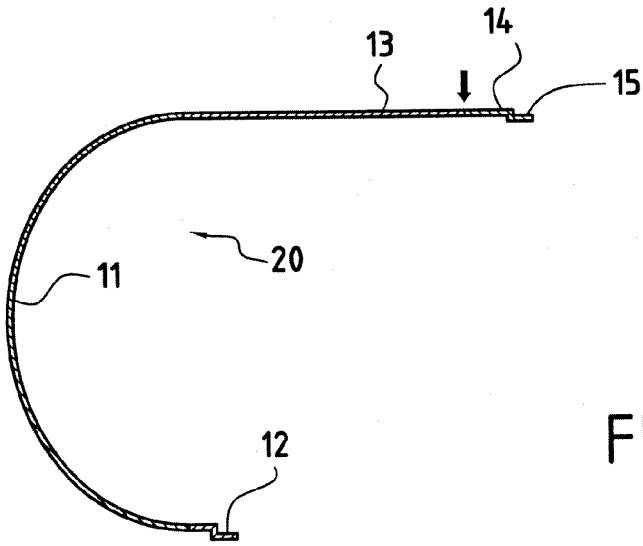

As shown in FIG. 1C, the other circular end of the cylindrical shell 13 is butt-welded to an intermediate connection ring 14 for use during final welding. The annular welding is performed under an inert gas. As mentioned above, the intermediate connection ring 14 has a cylindrical mounting surface 15 of reduced diameter. Its dimensions are determined by machining. For example, it may have a chamfer in the vicinity of the shoulder defining the surface of reduced diameter. The chamfer may serve to provide filler metal during the final welding operation.

At the end of the operation shown in FIG. 1C, a first subassembly 20 forming the entire outer portion of a "reverse-flow" combustion chamber has been made.

Figure 2A:
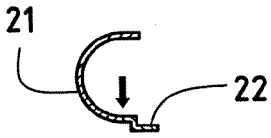
FIGS. 2A to 2C show various welding operations for making up a second subassembly.
Figure 3:
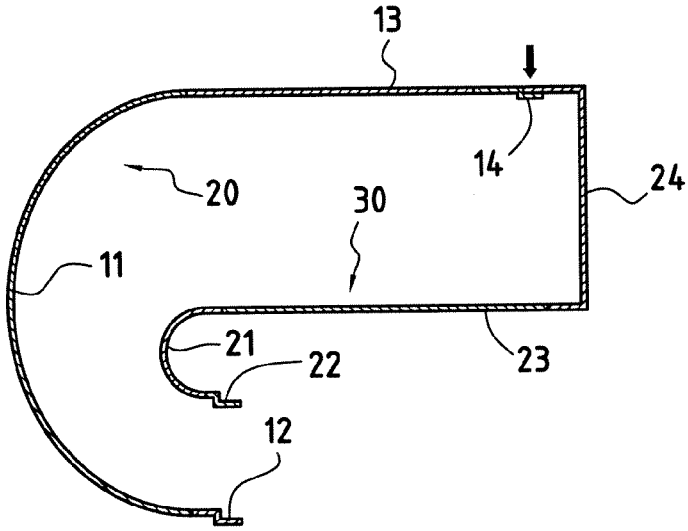
FIG. 3 shows an orbital welding operation for uniting the two subassemblies to constitute a reverse-flow combustion chamber.

In accordance with the operation shown in FIG. 2A, a stamped sheet metal shell 21 for forming the inner bend of the combustion chamber is butt-welded with a connection ring 22 having the same function as that of FIG. 1A and likewise intended for subsequent connection to the turbine.

Figure 2B:
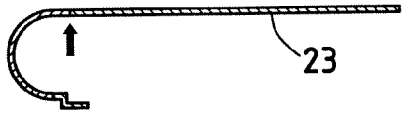

In accordance with FIG. 2B, the other end of the inner bend of the combustion chamber is butt-welded under an inert gas with a cylindrical shell 23 that is to form the inner wall of the combustion chamber.

Figure 2C:
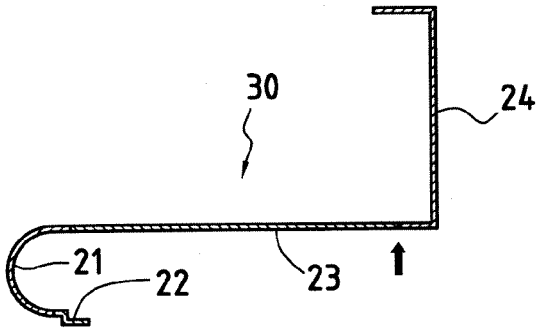

Thereafter, in accordance with FIG. 2C, the other end of the cylindrical shell 23 is butt-welded under an inert gas, to the inside edge of a shell 24 that is to constitute the end wall of the combustion chamber on which the injectors will be mounted.

At the end of the operation shown in FIG. 2C, a second subassembly 30 constituting the entire inner wall of the future combustion chamber has been made, together with the end wall of the chamber.

In accordance with FIG. 3, the two subassemblies 20 and 30 are docked one with the other, the intermediate connection ring 14 being fitted against the end wall of the chamber 24 and welded thereto by orbital welding, e.g. using a laser, and under an inert gas, as indicated by the arrow. As mentioned above, the filler metal required is provided by said intermediate connection ring.

It should be observed that, given the structure of the intermediate connection ring, the final welding operation does not disturb the flow of air around the combustion chamber.

In addition, the fact that the combustion chamber obtained in this way has a "smooth" outer wall makes it easier to position the laser equipment used for making the multiple orifices perforated in the wall of the combustion chamber.

The type of welding used ensures best possible thermomechanical behavior for the combustion chamber. Fabrication cost is reduced.

What is claimed is:

1. A method of fabricating a combustion chamber comprising welded-together shells, the method comprising:

making a first combustion chamber subassembly comprising a first set of welded-together shells;

making a second combustion chamber subassembly comprising a second set of welded-together shells;

welding an intermediate connection ring comprising a cylindrical mounting surface to one end of said first subassembly;

engaging one end of said second subassembly on said mounting surface; and assembling said second subassembly to said cylindrical mounting surface by orbital welding, wherein the intermediate connection ring is provided on an inside surface of the first and second combustion chamber subassemblies.

2. The method according to claim 1, wherein said intermediate connection ring is made at least in part by machining.

3. The method according to claim 1, wherein said intermediate connection ring includes or constitutes the filler metal needed for welding with said second subassembly.

4. The method according to claim 1, wherein other connection rings are butt-welded with respective other ends of the two subassemblies.

5. The method according to claim 1, wherein the first combustion chamber subassembly includes an arcuate shell and a cylindrical shell, and wherein a first end of the cylindrical shell is welded to a first end of the arcuate shell and a second end of the cylindrical shell is welded to the intermediate connection ring.

6. The method according to claim 5, wherein the second combustion chamber subassembly includes an arcuate shell and a cylindrical shell, and wherein the cylindrical shell of the first subassembly is an outer wall of the combustion chamber and the cylindrical shell of the second subassembly is an inner wall of the combustion chamber.

7. The method according to claim 5, wherein an outer diameter of the intermediate connection ring is the same as an outer diameter of the cylindrical shell of the first subassembly, and the outer diameter of the cylindrical mounting surface is less than the outer diameter of the intermediate connection ring.

8. A method of fabricating a "reverse-flow" combustion chamber comprising welded-together shells, the method comprising:

making a first combustion chamber subassembly by butt-welding a first set of preformed shells;

making a second combustion chamber assembly by butt-welding a second set of preformed shells, one of which is an end wall of the chamber;

welding an intermediate connection ring comprising a cylindrical mounting surface to one end of said first subassembly;

engaging one end of said second subassembly on said mounting surface; and assembling said second subassembly to said cylindrical mounting surface by orbital welding, wherein the intermediate connection ring is provided on an inside surface of the first and second combustion chamber subassemblies.

9. The method according to claim 8, wherein the end wall of the chamber includes a first outer cylindrical portion which is welded to the cylindrical mounting surface and a second inner cylindrical portion which is welded to a cylindrical shell.

* * * * *